US007540359B2

(12) United States Patent
Veronesi et al.

(10) Patent No.: US 7,540,359 B2
(45) Date of Patent: Jun. 2, 2009

(54) ELECTRICAL CONNECTOR DEVICE FOR USE WITH ELEVATOR LOAD BEARING MEMBERS

(75) Inventors: William A. Veronesi, Hartford, CT (US); Paul A. Stucky, Stockton, CA (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/598,400

(22) PCT Filed: Mar. 16, 2004

(86) PCT No.: PCT/US2004/007901

§ 371 (c)(1),
(2), (4) Date: Aug. 28, 2006

(87) PCT Pub. No.: WO2005/094249

PCT Pub. Date: Oct. 13, 2005

(65) Prior Publication Data

US 2007/0181385 A1 Aug. 9, 2007

(51) Int. Cl.
*B66B 7/00* (2006.01)

(52) U.S. Cl. ..... 187/413; 187/391; 187/247

(58) Field of Classification Search ..... 187/247, 187/319–394, 413; 340/664, 235, 240, 242, 340/310.01

See application file for complete search history.

(56) References Cited

U.S. PATENT DOCUMENTS 4,145,920 A 3/1979 Yamagami
5,120,905 A 6/1992 Cousin et al.
5,731,528 A * 3/1998 Yamazaki et al. ..... 73/862.41
5,834,942 A 11/1998 De Angelis
6,073,728 A 6/2000 Olsen et al.
6,510,924 B2 * 1/2003 Bauer et al. ..... 187/380
6,633,159 B1 10/2003 Robar et al.
6,653,943 B2 11/2003 Lamb et al.
2003/0089558 A1 * 5/2003 Zepke et al. ..... 187/413
2004/0026177 A1 * 2/2004 Ayano et al. ..... 187/247

FOREIGN PATENT DOCUMENTS

JP 2002-181792 6/2002

OTHER PUBLICATIONS

PCT International Search Report for International application No. PCT/US04/07901, mailed Oct. 28, 2005.
PCT Written Opinion of the International Searching Authority for International application No. PCT/US04/70901, Oct. 28, 2005.

* cited by examiner

*Primary Examiner*—Jonathan Salata
(74) *Attorney, Agent, or Firm*—Carlson, Gasker & Olds, P.C.

(57) ABSTRACT

An electrical connector device (40) for use with an elevator load bearing member (30) assembly includes at least one electrical connector member (42) for making electrically conductive contact with at least one tension member (32). A clamping member (45) supports the electrical connector member and facilitates manipulating the connector member to pierce through a coating (34) over the tension members (32). The clamping member (45) in one example has first (46) and second (48) portions received on opposite sides of the load bearing member (30). An adjuster (50) facilitates adjusting the relative positions of the clamping member portions to urge the electrical connector member through the coating and into electrically conductive contact with the tension member.

23 Claims, 3 Drawing Sheets

ELECTRICAL CONNECTOR DEVICE FOR USE WITH ELEVATOR LOAD BEARING MEMBERS

FIELD OF THE INVENTION

This invention generally relates to electrical connectors for making a conductive connection with at least one tension member in an elevator load bearing member.

DESCRIPTION OF THE RELATED ART

Elevator systems typically include a load bearing member such as a rope or belt that bears the weight of the car and counterweight and allows the car to be moved as desired within the hoistway. For many years, steel ropes were used. More recently, coated steel belts have been introduced that include a plurality of tension members encased within a jacket. In one example, the tension members are steel cords and the jacket comprises a polyurethane material.

The new arrangements present new challenges for monitoring the load bearing capabilities of the load bearing member over the life of the elevator system.

A variety of techniques for monitoring modern elevator load bearing members are being developed. This invention provides the ability to readily and accurately establish an electrically conductive connection with at least one of the tension members to facilitate an electricity-based monitoring technique.

SUMMARY OF THE INVENTION

In general terms, this invention is a device for malting an electrical connection with at least one tension member of an elevator load bearing member.

One example device includes at least one electrical connector member that is adapted to penetrate through a coating over a tension member. A clamping member is received on at least one side of the coating and supports the electrical connector member. Circuitry for processing information gathered by the connector member and including at least one shorting conductor for electrically coupling at least two tension members is supported by the clamping member.

In one example, the clamping member has first and second portions that are received on opposite sides of the load bearing member. The adjuster causes the first and second portions to move toward each other so that the connector member is urged into contact with the tension member.

An example elevator load bearing assembly includes a plurality of tension members encased within a non-conductive jacket. At least one electrical connector member extends at least partially through the jacket to make an electrically conductive contact with at least one of the tension members. A clamping member received on an outside of the jacket supports the electrical connector. The clamping member also supports circuitry for processing information gathered from the electrical connector member.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
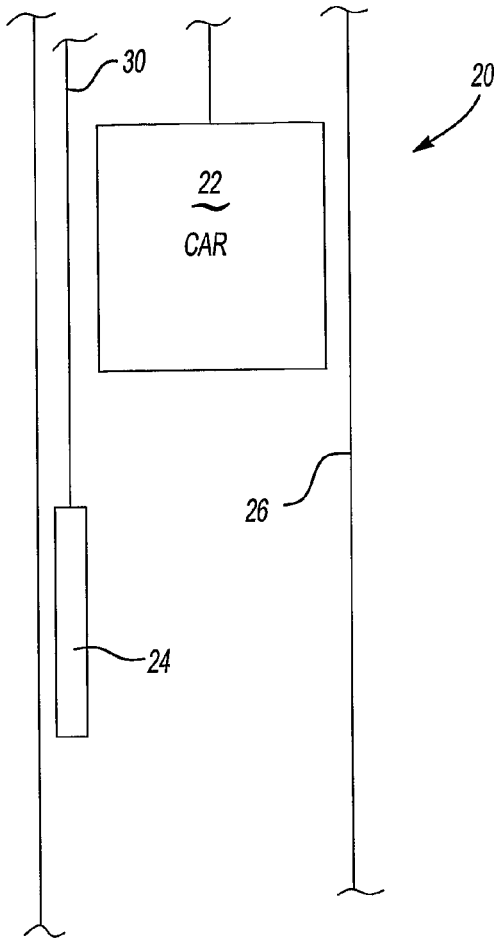
FIG. 1 schematically illustrates selected portions of an elevator system.

FIG. 1 schematically illustrates selected portions of an elevator system 20. A car 22 moves with a counterweight 24 within a hoistway 26 in a conventional manner. A load bearing member 30 supports the weight of the car 22 and counterweight 24 and interacts with at least one drive sheave of a machine (not illustrated) to cause the desired movement of the car and counterweight within the hoistway.

Figure 2:
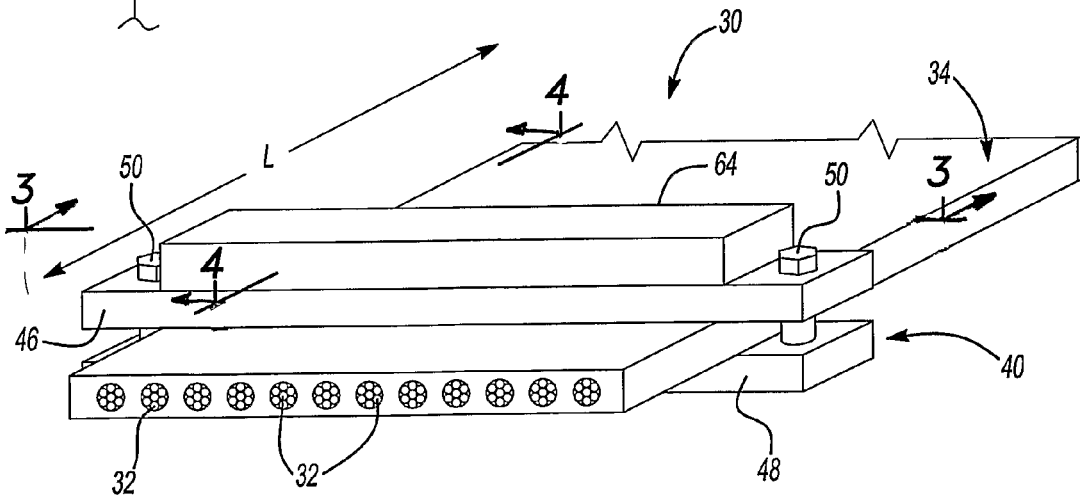
FIG. 2 schematically illustrates an elevator belt to which an example embodiment of a connector device designed according to this invention is secured.

FIG. 2 schematically illustrates a portion of one example load bearing member 30, which is a coated steel belt. The example of FIG. 2 is for discussion purposes and this invention is not necessarily limited to a particular style of belt or load bearing member. In this example, a plurality of tension members 32 extend longitudinally (i.e., the direction L shown in FIG. 2) within the belt 30. In one example, the tension members 32 each comprise steel strands that are wound into a cord in a conventional manner.

The tension members 32 are encased in a jacket 34, which in one example comprises a polyurethane material.

As schematically shown in FIG. 2, the belt 30 has an electrical connector device 40 associated with it. As best appreciated from FIGS. 3 and 4, the connector device 40 has a plurality of electrical connector members 42. One end 44 of the connector members 42 is configured to be able to pierce through the jacket 34 on the belt 30 such that the connector members 42 make electrical contact with the tension members 32. In one example, the connector members 42 comprise steel.

The illustrated example includes a clamping member 45 having a first portion 46 and a second portion 48. The first and second portions 46 and 48 are received on opposite sides of the belt 30. An adjuster 50 facilitates manipulating the first portion 46 relative to the second portion 48 such that the ends 44 of the connector members 42 are urged through the jacket material 34 into electrically conductive contact with the tension members 32. In the illustrated example, the adjuster 50 includes at least a partially threaded exterior 52 that is received within a correspondingly threaded receiver portion 54 on the second portion 48 of the clamping member. By rotating the adjusters 50, the first and second portions of the clamping member 45 are drawn together, which urges the connector members 42 through the jacket material 34 into electrical contact with the tension members 32. In one example, the adjustors 50 and receiver portions are configured (by timing the threads, for example) to provide a visible confirmation of a full connection between the connector members 42 and tension members 32.

In other examples, the clamping members are urged together in a different manner and other arrangements are used to hold the connector device in place.

Figure 3:
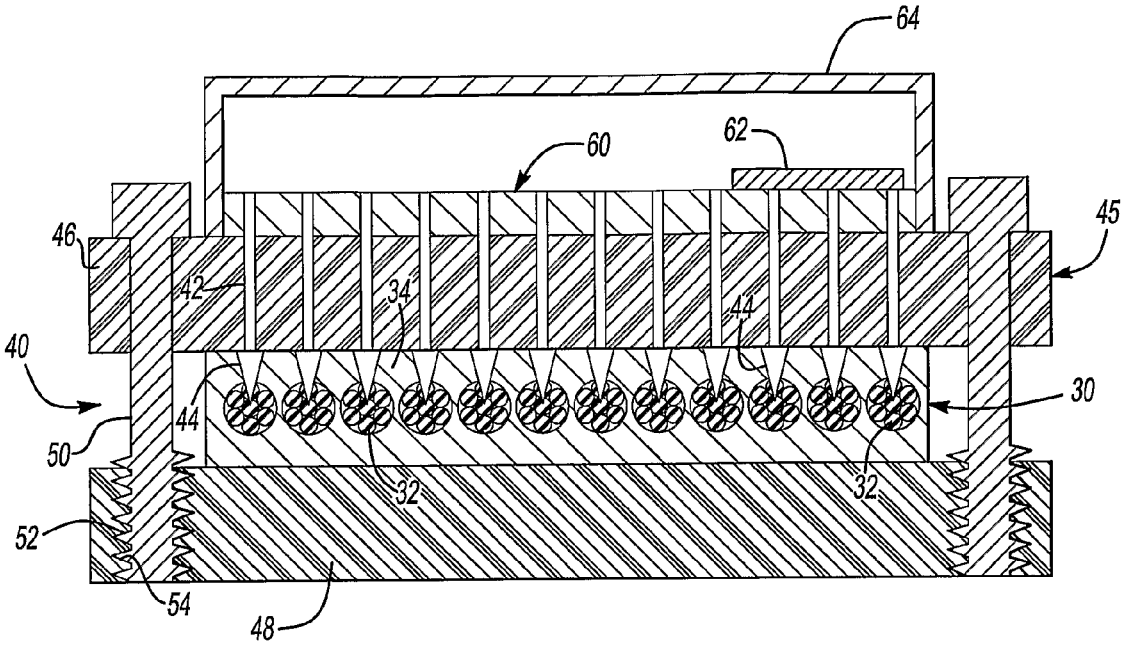
FIG. 3 is a cross-sectional view along the lines 3-3 in FIG. 2.

As can be appreciated from FIG. 3, the connector device 40 includes at least one connector member 42 corresponding to each of the tension members 32 within the belt 30. As can be appreciated from FIG. 4, each tension member 32 preferably is contacted by more than one electrical connector member 42, which provides redundancy in the event that one of the connector members 42 associated with a particular tension member 32 breaks or otherwise fails to establish or maintain sufficient contact.

In one example, the clamping member portions 46 and 48 are made from a non-conductive, plastic material. In the illustrated example, the first portion 46 supports the connector members 42 and a printed circuit board 60. At least circuitry and one electronic component 62 such as a microprocessor chip, for example, is supported by the example printed circuit board 60 for gathering and processing information from at least one connector member 42. Although not specifically illustrated, circuit traces on the circuit board 60 may facilitate interconnections between the connectors 42 and other electronics of a belt condition monitoring system.

In the illustrated example, the printed circuit board 60 and supported electronics 62 are housed within a housing 64 that is secured to the first portion 46 of the clamping member 45. In one example, the circuitry on board the first portion 46 is capable of providing an output that indicates a condition of a tension member or the entire load bearing member.

Figure 4:
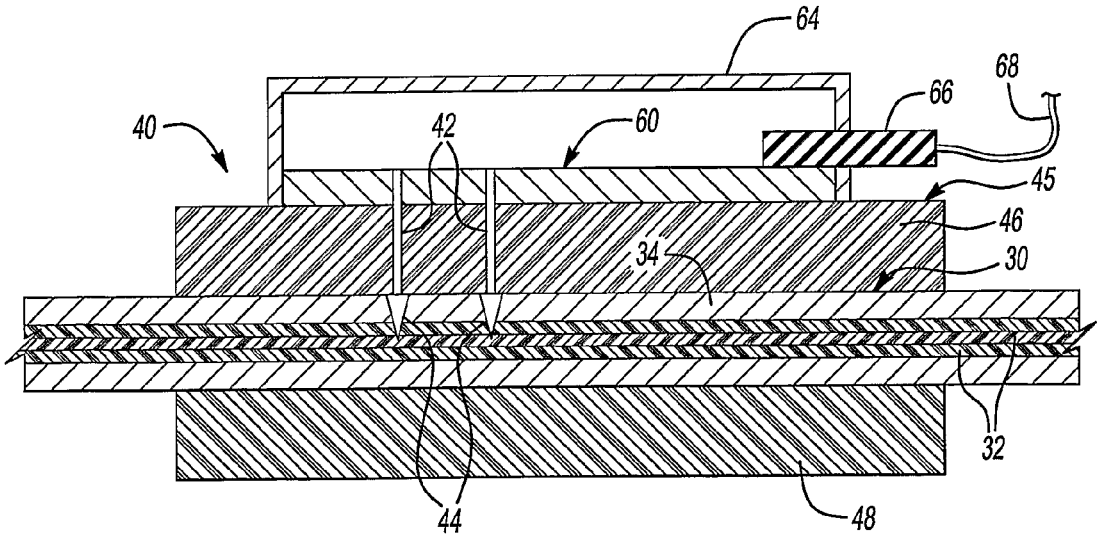
FIG. 4 is a cross-sectional illustration taken along the lines 4-4 in FIG. 2.

As can be appreciated from FIG. 4, the circuit board 60 facilitates securing a coupling device 66 having at least one lead 68 for communicating power and/or control signals to the connector members 42 for appropriate monitoring of the tension members 32. In another example, battery power and wireless signal transmissions are used and there is no lead making a hand wired connection with another device.

Figure 5:
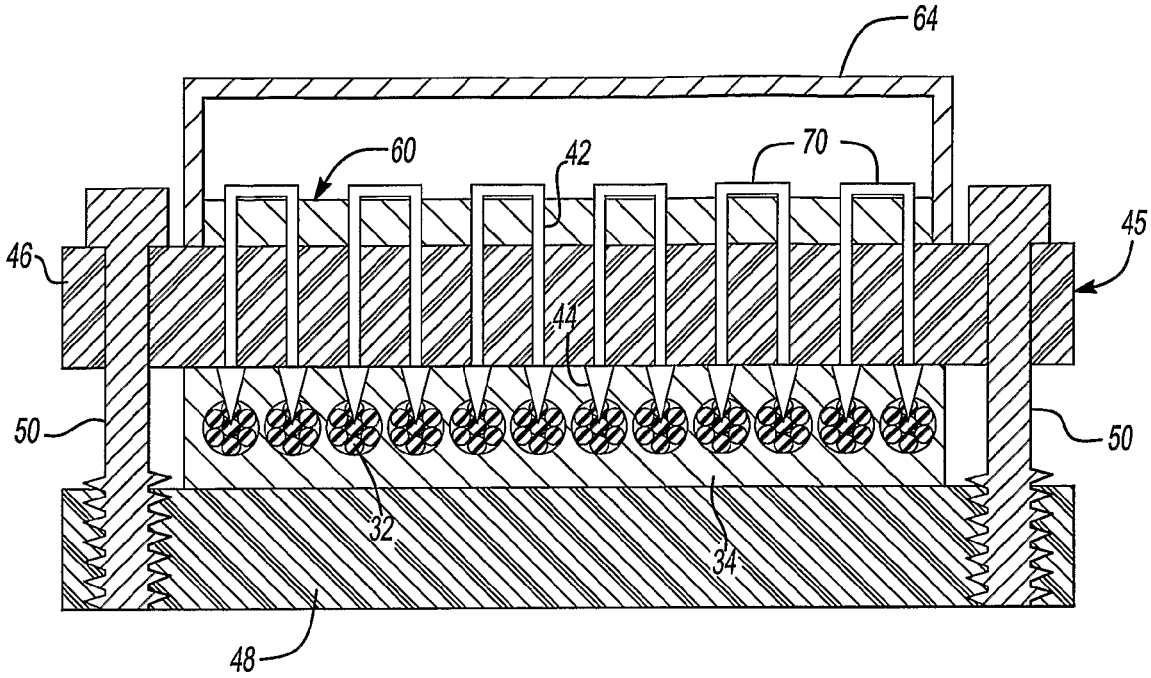
FIG. 5 is a cross-sectional illustration similar to FIG. 3 of another example connector designed according to an embodiment of this invention.

FIG. 5 illustrates another example embodiment similar to the view of FIG. 3. In this example, selected connector members 42 are interconnected by circuit traces 70 supported on the printed circuit board 60. The circuit traces 70 effectively short one connector to the other and establish the possibility for having a continuous conductive path extending along some or all of the tension members 32 within the belt 30. For example, the left-most tension member may be one end of the continuous circuit path and the right-most tension member 32 may be an opposite end of the circuit with all of the intermediate tension members 32 being branches along the circuit path. One example embodiment has a first connector device near one end of a belt like that shown in FIG. 3 and a separate connector device as shown in FIG. 5 near an opposite end of the belt. Such an arrangement yields a series coupling of the tension members along the belt.

Depending on the particular monitoring strategy and associated components chosen, those skilled in the art will be able to design appropriate connections with the connector members 42 to establish the desired operation. With the illustrated connectors, one example monitoring technique is resistance-based. One example technique is disclosed in the published application WO 00/5376. The teachings of that document are incorporated by reference into this description. Given this description, those skilled in the art will be able to select from appropriate materials for forming the various components of an electrical connector device designed according to this invention.

By integrating the circuitry, electronics and housing into the clamping device, this invention presents a more economical and reliable approach to making electrical connections with tension members within an elevator belt. The unique arrangement of components allows for simple and reliable installation of a connector device for establishing electrically conductive connections.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for making electrical contact with at least one tension member in a load bearing member used in an elevator system, comprising:

a clamping member that is received on at least one side of the load bearing member;

at least one electrical connector member supported by the clamping member and adapted to penetrate through a coating over the one tension member into a position to make electrically conductive contact with the tension member; and circuitry supported by the clamping member that is capable of processing information gathered from the connector member.

2. The device of claim 1, wherein the clamping member has first and second portions that are received on opposite sides of the load bearing member, movement of at least one portion being operative to urge the connector member into contact with the tension member.

3. The device of claim 2, including an adjustor that causes movement of one portion toward the other portion.

4. The device of claim 3, wherein the adjustor is threaded and rotatable relative to the clamping member to cause relative movement between the first and second portions.

5. The device of claim 4, wherein at least one of the first or second portions has a threaded receiver that cooperates with the threaded adjustor.

6. The device of claim 1, including a housing supported by the clamping member and at least one electronic component within the housing that is coupled with the connector member.

7. The device of claim 6, including a printed circuit board within the housing having the circuitry and the electronic component supported on the board.

8. The device of claim 1, wherein the electrical connector member has an engaging surface that is adapted to penetrate at least partially through a coating over the tension member to thereby make the electrically conductive contact.

9. The device of claim 1, including a plurality of electrical connectors adapted to make contact with a corresponding plurality of tension members.

10. The device of claim 9, wherein the plurality of connectors is greater than the plurality of tension members and more than one connector is adapted to contact each tension member.

11. The device of claim 1, including at least one shorting conductor that electrically connects at least one tension member to at least one other tension member to establish a continuous, electrically conductive path along corresponding tension members.

12. The device of claim 11, wherein the connector members are coupled to establish a continuous conductive path along all of the tension members.

13. The device of claim 11, wherein the shorting conductor is supported near an opposite end of the load bearing member from the electrical connector member.

14. A method of establishing an electrically conductive contact with at least one tension member in a load bearing member used in an elevator system, comprising:

providing a connector having at least one electrical connector member supported by a clamping member that also supports circuitry for processing information gathered from the electrical connector member;

placing the at least one conductive connector member adjacent a coating over the tension member; and forcing the connector member at least partially through the coating sufficient to make an electrically conductive contact between the connector member and the tension member.

15. The method of claim 14, wherein the load bearing member has a plurality of tension members and including forcing at least one connector member into conductive contact with each of the tension members.

16. The method of claim 15, including forcing at least a terminal end of the connector member at least partially into the tension member.

17. The method of claim 14, including positioning the clamping member adjacent the load bearing member and forcing the clamping member and the connector member toward a center of the load bearing member.

18. The method of claim 17, including positioning a portion of the clamping member on each side of the load bearing member and forcing the portions toward to each other.

19. The method of claim 14, including shorting at least one tension member to at least one other tension member.

20. An elevator load bearing assembly, comprising:

a plurality of electrically conductive tension members;

a non-conductive coating over the tension members;

at least one electrical connector member extending at least partially through the coating over the tension member such that the electrical connector member makes electrically conductive contact with at least one of the tension members;

a clamping member received on at least one side of the coating, the clamping member supporting the electrical connector member such that the connector member remains in electrically conductive contact with the tension member; and circuitry supported by the clamping member for processing information gathered from the connector member.

21. The assembly of claim 20, wherein the clamping member has a first portion received on a first side of the coating and a second portion received on a second side of the coating and including an adjuster that adjusts the relative position between the first and second clamping member portions for adjusting a position of the connector member relative to the tension member.

22. The assembly of claim 20, including a plurality of connector members, at least one connector member making electrically conductive contact with each of the tension members.

23. The assembly of claim 20, including at least one shorting conductor for electrically coupling at least two of the tension members.

* * * * *